US007186143B2

(12) United States Patent
Plecher et al.

(10) Patent No.: US 7,186,143 B2
(45) Date of Patent: Mar. 6, 2007

(54) SEALING APPARATUS ASSEMBLY FOR SEALING A PIEZOACTUATOR AND METHOD FOR SEALING A PIEZOACTUATOR

(75) Inventors: Klaus Plecher, Zeitlarn (DE); Marcus Unruh, Zeitlarn (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/205,869

(22) Filed: Aug. 17, 2005

(65) Prior Publication Data

US 2006/0040551 A1 Feb. 23, 2006

(51) Int. Cl.
*H01R 13/40* (2006.01)

(52) U.S. Cl. ..... 439/587; 439/322; 239/88

(58) Field of Classification Search ..... 439/587, 439/559, 322, 349, 598; 239/88
See application file for complete search history.

(56) References Cited

U.S. PATENT DOCUMENTS

| | | | | |
|---|---|---|---|---|
| 3,495,102 A | | 2/1970 | List et al. | 310/8 |
| 5,017,740 A | * | 5/1991 | Honkomp et al. | 174/152 GM |
| 5,244,180 A | | 9/1993 | Wakeman et al. | 251/129.16 |
| 5,476,079 A | | 12/1995 | Kanamori et al. | 123/458 |
| 6,899,570 B2 | * | 5/2005 | Afanasiev et al. | 439/737 |
| 6,974,088 B2 | | 12/2005 | Albert et al. | 239/88 |
| 2005/0006495 A1 | | 1/2005 | Schurz et al. | 239/102.2 |
| 2006/0038030 A1 | * | 2/2006 | Plecher et al. | 239/88 |

FOREIGN PATENT DOCUMENTS

| | | |
|---|---|---|
| DE | 44 43 004 A1 | 6/1995 |
| DE | 19844742 | 3/2000 |
| DE | 19844743 | 6/2000 |
| DE | 102 50 202 A1 | 5/2004 |
| DE | 10251225 | 5/2004 |
| WO | 03069152 | 8/2003 |

* cited by examiner

*Primary Examiner*—Hae Moon Hyeon
(74) *Attorney, Agent, or Firm*—Baker Botts L.L.P.

(57) ABSTRACT

In a method and arrangement for sealing a piezoactuator having terminal pins (12) protruding from the piezoactuator and a top plate (14) surmounting the piezoactuator, the top plate is provided with openings (16) to enable the terminal pins (12) to pass through. In order to ensure a reliable seal even for comparatively thin top plates (14) in particular, the invention proposes placing a sealing-ring (28) made from an elastic sealant material on each of the terminal pin sections (30) protruding from the openings (16), so that the sealing ring fits tightly to a circumferential surface (32) of the terminal pin section (30), as well as to the top plate (14), forming a seal, and being pressure-injected into the top plate (14) by means of a plastic extrusion coating (arrows in FIG. 1).

23 Claims, 3 Drawing Sheets

SEALING APPARATUS ASSEMBLY FOR SEALING A PIEZOACTUATOR AND METHOD FOR SEALING A PIEZOACTUATOR

CROSS-REFERENCE TO RELATED APPLICATIONS

This application claims priority to German Patent Application No. 10 2004 040 072.5, which was filed on Aug. 18, 2004, and is incorporated herein by reference in its entirety.

TECHNICAL FIELD

The present invention relates to an arrangement for sealing and a method for sealing.

BACKGROUND

Such an arrangement and such a method are known from document DE 102 51 225 A1 for example. In order to create a permanent and in particular oil-tight seal between a piezoactuator and an external contacting compression bond, this prior art proposes inserting a fuel-resistant O-ring in each opening of a surmounting top plate. In addition a sleeve of insulating material is inserted in each opening, beneath the O-ring, providing centering and electrical insulation for the terminal pin.

The disadvantage of this known piezoactuator contacting compression bond is that a comparatively thick top plate is needed in order to attach an O-ring and a centering sleeve in each of its openings.

SUMMARY

The object of the present invention is therefore to design an arrangement for sealing and a method for sealing, of the type initially mentioned, in such a way that a reliable seal is possible even for comparatively thin top plates in particular.

In the arrangement for sealing to which the invention relates it is proposed that an O-ring made from an elastic sealant material should be placed on each of the terminal pin sections protruding from the openings, said O-ring fitting tightly to a circumferential surface of the terminal pin section, as well as to the top plate, forming a seal, and being pressure-injected into the top plate by means of a plastic extrusion coating.

Fitting the O-ring on both the circumferential surface of the terminal pin section and the top plate forms a reliable seal, and pressure-injecting the O-ring with the aid of a plastic extrusion coating makes the seal particularly effective.

Of significance in this respect is the fact that the pressure-injection of the O-ring material produces in said material a permanent internal compressive stress which can be used to apply compressive loading to the section of the O-ring used for producing the sealing effect. All types of elastomer are thus particularly suitable as an elastic O-ring material. For example the O-ring can be made from polyurethane, Viton (proprietary name) etc.

In one embodiment the O-ring fits tightly against the circumferential surface of the terminal pin section with elastic pre-stress. This means that in principle a seal can be achieved at this point even without using the pressure created by the pressure-injection. Rather, in this case the seal against the circumferential surface of the terminal pin section is obtained because an O-ring with an opening cross-sectional area is placed on the terminal pin section, and when the O-ring is in its relaxed state this cross-sectional area is smaller than the cross-sectional area of the terminal pin section in the area of the seal between said terminal pin section and the O-ring, from now on also referred to as a "radial seal". Even this embodiment, however, in no way excludes the pressure-injection of the O-ring by means of the plastic extrusion coating from also bringing about a radial strengthening of the fit of the O-ring around the circumferential surface of the terminal pin section.

In a preferred embodiment the O-ring has at least one collar facing radially inward so as to fit around the circumferential surface of the terminal pin section. By providing one or more such collars, the sealing effect of the radial seal can be advantageously concentrated in one or more places.

The O-ring can also have at least one collar directed axially toward the top plate so that it fits against said top plate, for instance in order to concentrate the sealing effect at this sealing point also. The seal between the O-ring and the top plate will from now on also be referred to as the "axial seal".

A compact design of the O-ring occurs when, for example, the O-ring has a first, radial inner section which extends mainly in the axial direction along the terminal pin section, and an adjoining second, radial outer section which extends mainly in the radial direction along the top plate. The shape of the O-ring is then rather like a hat (open at the top to allow the terminal pin section to pass through). In this case the said collars for the radial seal can be arranged in the first O-ring section and the said collars for the axial seal can be arranged in the second O-ring section.

The fact that the O-ring is "pressure-injected into the top plate by means of a plastic extrusion coating" is not intended in any way to imply that the O-ring itself must necessarily be stressed by the plastic extrusion coating directly, or that the O-ring itself is extrusion-coated with plastic. Even though such an embodiment is not to be excluded, there is a preferred embodiment in which a structure is provided that at least partially covers the O-ring, from now on referred to as a "protective covering". In this case the pressure injection can thus also affect the O-ring at least in part indirectly, that is to say, through the protective covering. For this purpose it is in many cases advantageous if the protective covering or at least some section thereof fits flush to the O-ring.

A number of advantages can be obtained from using a protective covering.

In the first place it is possible for the protective covering to avoid or reduce harmful effects on the O-ring material due to the material in the plastic extrusion coating (depending on the choice of O-ring material).

Moreover, by suitably designing the transition area between the inner side of a protective covering (i.e. the side facing the O-ring) and/or suitably designing the outside of the O-ring (i.e. the side facing the protective covering), the pressure created by the pressure injection and initially exerted on the protective covering can be deliberately transmitted to the O-ring. In particular the compressive stress can be concentrated on the sections of O-ring provided for the radial seal and/or axial seal.

Furthermore, by using a protective covering it is possible to increase constructional freedom when designing the O-ring and/or to simplify the manufacturing step of the plastic injection coating. If in fact no protective covering is placed on the O-ring before this stage in manufacture, there exists in principle a danger that the liquid plastic material will penetrate into the gaps to be sealed between the O-ring and the terminal pin section on the one hand, and between the O-ring and the top plate on the other, before the injection pressure has closed these gaps (due to the application force of O-ring material), which would prevent penetration of the liquid plastic material. Although it is possible to prevent such penetration of liquid plastic material into the gaps to be sealed, by designing a special shape for the O-ring and/or a special injection tool or extrusion method (e.g. so that during the injection process the liquid plastic material flows comparatively late into the vicinity of the gaps to be sealed), nonetheless such measures usually involve increased expense. If the protective covering is intended to have the function of avoiding such "underflowing" of the O-ring during the extrusion coating, it is appropriate for the protective covering to fit tightly against the circumferential surface of the terminal pin section on the one hand, and against the top plate on the other.

Lastly, a protective covering can be useful to some extent as an aid to installation when placing the O-ring on the protruding terminal pin section. A further simplification arises if the protective covering and the O-ring are held together, for instance as a prefabricated standard component. During assembly of the arrangement for sealing, this standard component can then be placed on the protruding terminal pin section. In order to hold the protective covering and the O-ring together it would be possible for example to provide a form fit connection such as a notch.

A preferred embodiment of the invention provides for the plastic extrusion coating to include an onward electrical connection, or at least some part thereof, connected to the terminal pin sections. The plastic extrusion coating then has a double function, on the one hand as a support for the compressive stress and on the other hand as a protection, in particular to provide the electrical isolation of an onward electrical connection. If the piezoactuator concerned is the drive component of a fuel injection valve for an internal combustion engine, this onward electrical connection can comprise for example an element known as a reed holder, which is soldered to the ends of the terminal pins in order to provide contact reeds of a connector that are electrically connected to the piezoactuator. A reed holder suitable for this purpose is disclosed for example in document DE 198 44 743 C1.

The method for sealing a piezoactuator, to which the invention relates, is characterized by the following steps:

placement of an O-ring made from an elastic sealant material on each of the terminal pin sections protruding from the openings, said O-ring being suitably designed to form a tight-fitting seal on the one hand with a circumferential surface of the terminal pin section and on the other hand with the top plate, and pressure injection of the O-ring into the top plate by means of a plastic extrusion coating.

This method can be provided in such a way that an arrangement for sealing is produced, having one or more of the special features mentioned above.

In particular the method can include the step of arranging a protective covering on the side of the O-ring facing away from the top plate before the pressure injection, for example simultaneously with the placement of the O-ring. Although a pressure injection of the O-ring that is adequate to obtain a desired sealing effect is usually already provided by the pressure of the injected plastic material, even so in order to increase the subsequent permanently-acting compressive stress, for example, and/or to obtain a spatially varying "compressive stress distribution", it is possible to provide that during extrusion of the plastic coating the O-ring is compressed or pressure-loaded (directly or if necessary indirectly by means of a section of a protective covering) by a component of an injection tool. By this means it is possible to obtain in particular a comparatively high injection pressure even when the pressure of the liquid plastic material is comparatively low.

BRIEF DESCRIPTION OF THE DRAWINGS

The invention will be described in greater detail below with the aid of some typical embodiments and by reference to the accompanying figures. These show the following.

DETAILED DESCRIPTION

Figure 1:
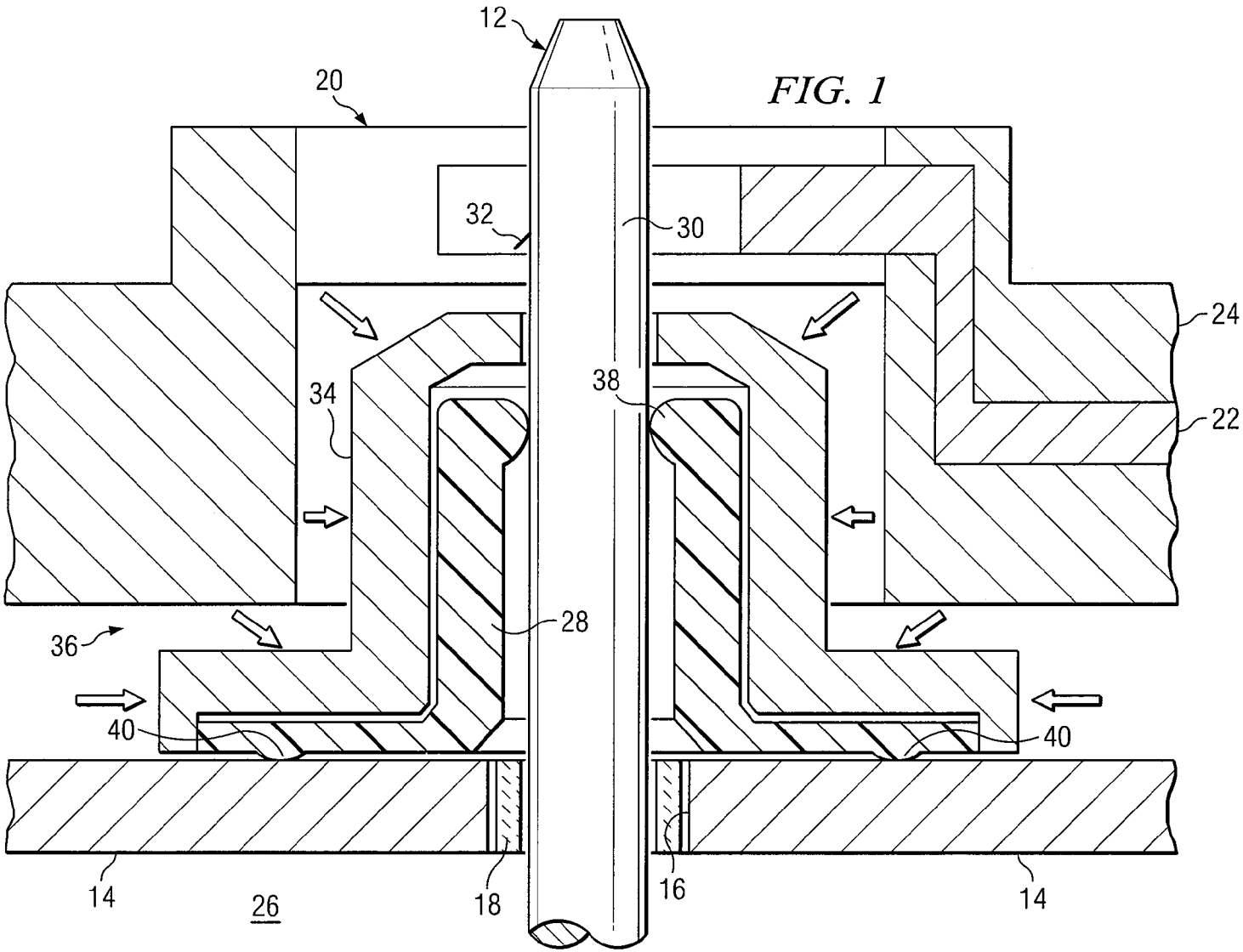
FIG. 1 shows a sectional view in the axial direction, in the seal area of the terminal pin of a piezoactuator.

FIG. 1 shows an arrangement for sealing a piezoactuator (not shown) for a fuel injection valve of an internal combustion engine. Of note is a terminal pin 12 protruding from the piezoactuator and a metal top plate 14 placed on the piezoactuator, said piezoactuator being in the form of a piezoelement stack, and said top plate supporting the axial forces acting when the piezoactuator is operating.

The figure shows the seal area on only one of two terminal pins of the piezoactuator. The arrangement for sealing provided on the second terminal pin (not shown) has the same configuration, described below.

The top plate 14 has an opening in the form of a hole 16 to enable the terminal pin 12 to pass through, an insulating sleeve 18 being inserted in an annular gap between the terminal pin 12 and the hole 16 so as to isolate the terminal pin 12 electrically from the top plate 14.

In a known way, an onward electrical connection to a connector of the fuel injector is produced by means of a contact module 20 that includes a slotted contact 22 soldered on in the area of the upper end of the terminal pin 12 and a plastic casing 24 which for instance is formed on the slotted contact 22.

The actuator space 26 which is located below the top plate 14, and in which the piezoactuator (not shown) is located, is permanently and reliably sealed by means of the arrangement for sealing described below, against the penetration of harmful substances (e.g. fuel, oil etc.) through the annular gap between the hole 16 and the terminal pin 12. In the typical embodiment shown, the sealing effect of the insulating sleeve 18 inserted in the said annular gap is practically negligible.

The seal is on the contrary provided by an O-ring 28 which is made of an elastomer and is placed so that it surrounds a terminal pin section 30 protruding from the hole 16.

The O-ring 28 fits tightly to a circumferential surface 32 of the terminal pin 12 (radial seal), as well as to the upper front end of the top plate 14 (axial seal) seen in FIG. 1, forming a seal.

Next the O-ring 28 and a protective covering 34 made of insulating plastic and completely covering said O-ring are positioned and the contact module 20 is arranged (soldered). Plastic material is then injected into a space 36 between the contact module 20 and the protective covering 34. This plastic coating causes the O-ring 28 to be pressure-injected by means of the protective covering 34 axially into the top plate 14 and radially into the terminal pin 12 (arrows in FIG. 1). The figure shows the situation immediately before extrusion of the plastic coating. The axial pressure injection can also be supported or intensified by a downholder during the extrusion of the plastic coating.

This amounts to a final plastic extrusion coating in the manufacturing process, during which the housing of a connector is extruded onto an end of a fuel injector housing containing the piezoactuator. Of significance is the fact that the axial pressure injection carried out during this injection process is permanently supported by the injection pressure and/or additionally by the compression which injection tool components apply to the O-ring, and by the subsequently "frozen" connector plastic.

The pressure injection of the O-ring 28 is permanent, since the O-ring is elastically compressed by the injection pressure during the extrusion of the plastic coating, so that an internal compressive stress is built up in the O-ring material. This compressive stress remains in the O-ring after the injection process has ended and is supported by the solidified plastic extrusion coating.

In the embodiment shown the O-ring 28 has a radially internal O-ring section which extends axially along the terminal pin section 30 and is provided at the upper end with a collar 38 facing radially inward, guaranteeing the radial seal. Due to its elastic pre-stress the O-ring 28 fits tightly to the circumferential surface 32 of the terminal pin 12, so that the compressive stress existing in the O-ring material after extrusion of the coating intensifies the sealing effect at this point only, for the pressure injection also has an effect in the radial direction on the O-ring 28 via the protective covering 34.

For the axial seal between the O-ring 28 and the top plate 14, which here is provided by fitting a collar 40 of the O-ring 28 arranged in a radially external section of the O-ring, the "frozen pressure" produced in the O-ring material by the extrusion of the coating is important, however, for a reliable sealing effect at this point. In the embodiment shown, this axial component of the injection pressure also acts on the O-ring 28 indirectly, that is to say, through the protective covering 34.

The O-ring 28 and the protective covering 34 have for the most part the same shape, having a radially internal section that extends axially, and a radially external section that extends radially. The inside of the protective covering 34 for the most part fits tightly to every facet of the outside of the O-ring 28. The injection pressure thus more or less equally transmitted or supported over the outside of the O-ring 28 is concentrated on the inside of the O-ring 28 by means of the collars 38 and 40 in the area of the gaps to be sealed.

The radially internal and radially external circumferential regions of the O-ring 28 are enveloped by the corresponding regions of the protective covering 34 in such a way that the end regions of the protective covering 34 are likewise fitted on the one hand to the circumferential surface 32 of the terminal pin 12 and on the other hand to the upper front end of the top plate 14. This design of the protective covering 34 prevents the liquid plastic material injected into the space 36 from intruding into the areas of the radial seal (collar 38) and the axial seal (collar 40).

As in the case of the O-ring 28, an electrically insulating material is also chosen for the protective covering 38 so as to isolate the terminal pin 12 electrically from the top plate 14 which in this case is metallic. For the purpose of obtaining a reliable seal by means of the pressure injection it is of less significance whether the material of the protective covering 34 deforms plastically or elastically or not during injection of the plastic material. To this extent there is a comparatively wide freedom of choice regarding the material for the protective covering.

Deviating from the typical embodiment introduced so far, the plastic casing 24 provided for the contact module 20 could also be manufactured in a single processing step at the same time as the plastic extrusion coating needed for pressure injection of the O-ring 28.

In the description of further typical embodiments which follows, the same reference numbers are used for like components with the addition of a lower case letter to differentiate the embodiment concerned. In the main only the differences relative to typical embodiments already described will be mentioned and reference will also be made expressly to the description of previous examples of embodiments.

Figure 2:
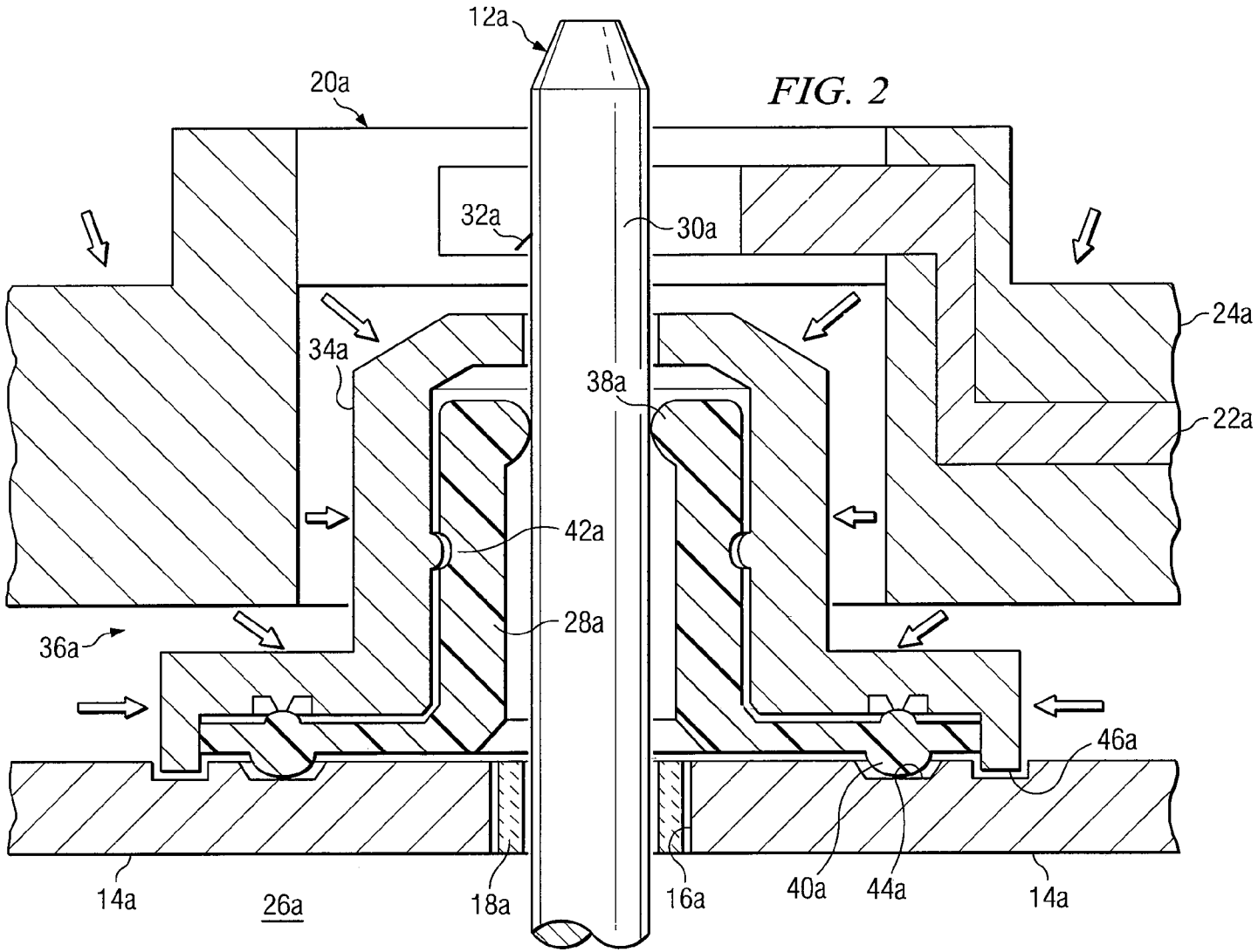
FIG. 2 shows a view corresponding to FIG. 1 according to a further embodiment of the arrangement for sealing.

FIG. 2 shows an embodiment to which some modifications have been made in comparison with the embodiment described with reference to FIG. 1.

The first thing to note is a notched form fit connection between the O-ring 28*a* and the protective covering 34*a* at 42*a*. This has the advantage that in the notched state the O-ring 28*a* together with the protective covering 34*a* can be placed as a single standard component on the terminal pin 12*a* and/or the top plate 14*a*. With a form fit connection of this kind, in this case a retaining lug in the protective covering 34*a* and a corresponding retaining slot on the outside of the O-ring 28*a*, it is possible to pre-assemble the O-ring in the protective covering. This creates a standard component which is easy to handle in the manufacturing process and greatly simplifies the assembly procedure.

Furthermore the top plate 14*a* has a first annular slot 44*a*, the base of which acts as a bearing surface for the axial collar 40*a*. In the embodiment shown this makes it possible for the O-ring areas radially adjacent to the collar 40*a* on both sides to sit flat on the top plate 14*a*.

A further modification, in this case visible on the axial collar 40*a*, is that the surface section of the O-ring 28*a* opposite the collar 40*a* and a corresponding surface section of the protective covering 34*a* have a special design for optimizing the pressure effect in the area of this axial seal. Alternatively or in addition, such a special design could also be provided in the area of the collar or collars in order to provide the radial seal.

Finally the radially external circumferential region of the protective covering 34*a* is angled into the top plate 14*a* and arranged so that it engages in a second annular slot 46*a*. As a result an improved seal of the "labyrinth" type is provided at this point to protect against penetration of the liquid plastic material during extrusion of the coating. It has in fact turned out that with a more or less narrow gap (e.g. press fit) between the terminal pin 12*a* and the protective covering 34*a*, and especially with a labyrinth seal (formed by the annular slot 46*a* in the top plate 14*a*, into which the external circumference of the protective covering is inserted) any noticeable penetration of liquid plastic can be reliably avoided by "freezing" and burring the plastic at this point. To some extent, hardening the plastic in these areas even contributes to preventing any further flow of plastic in these areas.

Figure 3:
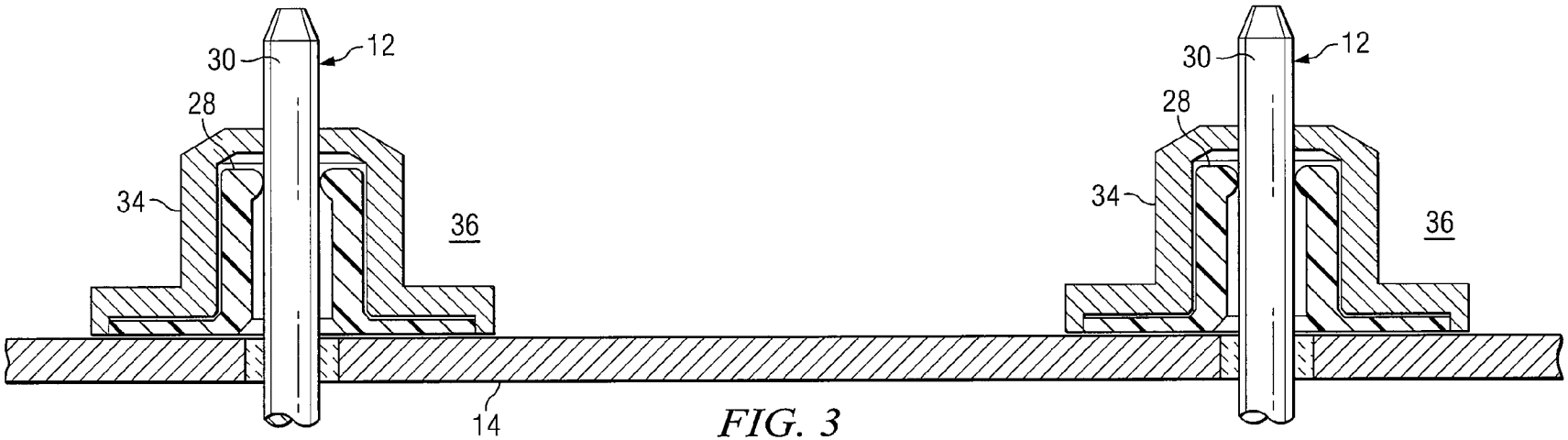
FIG. 3 shows a sectional view in the axial direction, in the seal area of two terminal pins of a piezoactuator.

In the embodiments described so far a separate protective covering is used for each terminal pin of the piezoactuator. Pressure injection of the O-rings arranged under them is performed in each case by a plastic extrusion coating common to both seal areas. The use of two separate protective coverings for two terminal pins of a piezoactuator is shown in FIG. 3 using the example of two arrangements for sealing having in each case the structure described with reference to FIG. 1.

Figure 4:
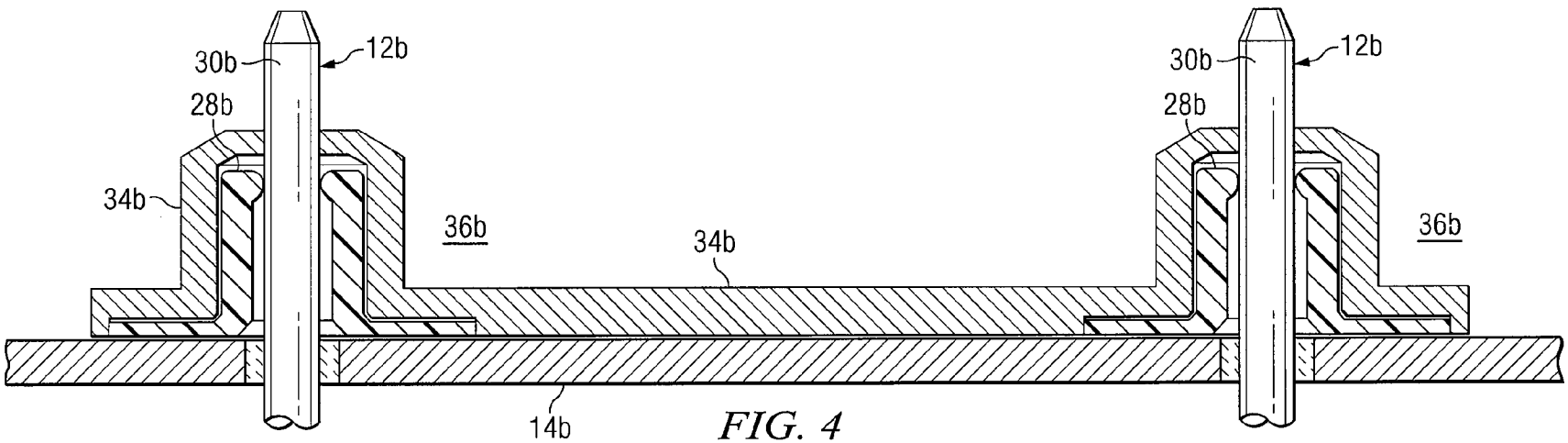
FIG. 4 shows a view corresponding to FIG. 3 according to a further embodiment (with a modified protective covering).

Deviating from this however, a common protective covering can also be used for a plurality of sealing arrangements of the type described above. A design of this kind is shown in FIG. 4. In this case, in place of two separate protective coverings a common protective covering 34*b* is placed on the terminal pins 12*b* which have been provided in advance with O-rings, and will then be stressed by the pressure of the plastic material injected into the space 36*b*. In this embodiment it would also be possible to provide the O-rings 28*b* together with the protective covering 34*b* as a standard component.

In summary, with the embodiments described a compact seal can be created for each terminal pin of a piezoactuator by means of which the penetration of harmful substances can be comprehensively avoided. Comparatively small radial dimensioning of the O-ring produces correspondingly very small surface areas via which liquid substances such as oil and water as well as gaseous substances such as water vapor etc. could penetrate, e.g. by diffusion. Advantageously the injection pressure of a final plastic extrusion coating can guarantee the axial pressure injection of the O-ring material in combination with a radial seal on the terminal pin due to elastic pre-stress and/or radial pressure injection.

An axial translation of force onto the terminal pins during the injection of plastic material can be avoided by a structural separation of the seal and the contact module (with pressure support on the contact module). Such an unfavorable axial force would however be created on the terminal pins if the injection pressure generated by a final connector extrusion coating were applied in one direction to the contact module soldered on previously.

What is claimed is:

1. A sealing apparatus assembly for a piezoactuator for a fuel injection valve of an internal combustion engine, comprising terminal pins protruding from the piezoactuator and a top plate surmounting the piezoactuator, said top plate being provided with openings to enable the terminal pins to pass through, wherein an O-ring made from an elastic sealant material is placed on terminal pin sections of said terminal pins protruding from the openings, wherein said O-ring is designed to fit tightly to a circumferential surface of the terminal pin section, as well as to the top plate, forming a seal, and wherein said O-ring is pressed against the top plate by means of a plastic extrusion coating.

2. The assembly for sealing according to claim 1, in which the O-ring fits tightly against the circumferential surface of the terminal pin section with elastic pre-stress.

3. The assembly for sealing according to claim 1, in which the O-ring has at least one collar facing radially inward so as to fit around the circumferential surface of the terminal pin section.

4. The assembly for sealing according to claim 1, in which the O-ring has a first, radial inner section which extends mainly in the axial direction along the terminal pin section, and an adjoining second, radial outer section which extends mainly in the radial direction along the top plate.

5. The assembly for sealing according to claim 1, in which the O-ring has at least one collar facing axially toward the top plate so as to fit on said top plate.

6. The assembly for sealing according to claim 1, in which the pressure injection further brings about a radial strengthening of the fit of the O-ring around the circumferential surface of the terminal pin section.

7. The assembly for sealing according to claim 1, in which a protective covering is arranged between the O-ring and the plastic extrusion coating.

8. The assembly for sealing according to claim 7, in which the protective covering and the O-ring are held together by form fit.

9. The assembly for sealing according to claim 7, in which the protective covering or at least some section thereof fits flush to the O-ring.

10. The assembly for sealing according to claim 7, in which the protective covering fits tightly against the circumferential surface of the terminal pin section, as well as against the top plate.

11. The assembly for sealing according to claim 1, in which the plastic extrusion coating includes an onward electrical connection, or at least some part thereof, connected to the terminal pin sections.

12. The method according to claim 11, wherein said O-ring has a T-Shape cross section.

13. The assembly according to claim 1, wherein said O-ring has a T-Shape cross section.

14. A method for sealing a piezoactuator for a fuel injection valve of an internal combustion engine, having terminal pins protruding from the piezoactuator and a top plate surmounting the piezoactuator, said top plate being provided with openings to enable the terminal pins to pass through, the method comprising the steps of:

placing an O-ring made from an elastic sealant material on terminal pin sections of said terminal pins protruding from the openings, said O-ring being suitably designed to form a tight-fitting seal on the one hand with a circumferential surface of the terminal pin section and on the other hand with the top plate, and pressure injecting a plastic extrusion coating to press the O-ring against the top plate.

15. The method according to claim 14, further including the arrangement of a protective covering on the side of the O-ring facing away from the top plate before the pressure injection.

16. The method according to claim 14, in which the O-ring is compressed by a component of an injection tool during extrusion of the plastic coating.

17. A sealing apparatus assembly for a piezoactuator for a fuel injection valve of an internal combustion engine, comprising:

terminal pins protruding from the piezoactuator, a top plate surmounting the piezoactuator, said top plate being provided with openings to enable the terminal pins to pass through, and O-rings made from an elastic sealant material being pressed against the top plate by an injection-molding and thereby placed on terminal pin sections of said terminal pins protruding from the openings thereby fitting tightly to a circumferential surface of the terminal pin section and to the top plate.

18. The assembly according to claim 17, in which the O-ring fits tightly against the circumferential surface of the terminal pin section with elastic pre-stress.

19. The assembly according to claim 17, in which the O-ring has at least one collar facing radially inward so as to fit around the circumferential surface of the terminal pin section.

20. The assembly according to claim 17, in which the O-ring has a first, radial inner section which extends mainly in the axial direction along the terminal pin section, and an adjoining second, radial outer section which extends mainly in the radial direction along the top plate.

21. The assembly according to claim 17, in which the O-ring has at least one collar facing axially toward the top plate so as to fit on said top plate.

22. The assembly according to claim 17, in which the pressure injection further brings about a radial strengthening of the fit of the O-ring around the circumferential surface of the terminal pin section.

23. The assembly according to claim 17, wherein said O-ring has a T-Shape cross section.

* * * * *

UNITED STATES PATENT AND TRADEMARK OFFICE

CERTIFICATE OF CORRECTION

PATENT NO. : 7,186,143 B2
APPLICATION NO. : 11/205869
DATED : March 6, 2007
INVENTOR(S) : Klaus Plecher et al.

It is certified that error appears in the above-identified patent and that said Letters Patent is hereby corrected as shown below:

On the title page insert item (30) Foreign Application Priority Data:

August 18, 2004 (DE) 10 2004 040 072

Signed and Sealed this

Twenty-ninth Day of May, 2007

JON W. DUDAS
*Director of the United States Patent and Trademark Office*